US005937677A

United States Patent [19]

Lee

[11] Patent Number: 5,937,677

[45] Date of Patent: Aug. 17, 1999

[54] WASHING MACHINE HAVING A SPRAYING NOZZLE ASSEMBLY

[75] Inventor: Jae-Yoll Lee, Kyungki-Do, Rep. of Korea

[73] Assignee: Daewoo Electronics Co., Ltd., Seoul, Rep. of Korea

[21] Appl. No.: 08/807,919

[22] Filed: Feb. 28, 1997

[30] Foreign Application Priority Data

Feb. 29, 1996 [KR] Rep. of Korea ..... 96-3529

[51] Int. Cl.[6] ..... D06F 39/08

[52] U.S. Cl. ..... 68/23.5; 68/13 R; 68/207; 68/208

[58] Field of Search ..... 68/207, 208, 13 R, 68/23.5

[56] References Cited

U.S. PATENT DOCUMENTS

| | | | |
|---|---|---|---|
| 1,724,234 | 8/1929 | Thomas | 68/23.5 |
| 2,254,003 | 8/1941 | De Marco | 68/53 |
| 2,588,535 | 3/1952 | Kahn | 68/23.5 |
| 2,619,977 | 12/1952 | Hagen | 68/207 |
| 4,809,524 | 3/1989 | Sickert . | |
| 5,285,664 | 2/1994 | Chang et al. . | |

FOREIGN PATENT DOCUMENTS

| | | | |
|---|---|---|---|
| 498318 | 3/1950 | Belgium | 68/23.5 |
| 54-7769 | 1/1979 | Japan | 68/207 |
| 61-22600 | 6/1986 | Japan | 68/207 |
| 63-15878 | 4/1988 | Japan | 68/207 |
| 2 103 253 | 2/1983 | United Kingdom . | |

*Primary Examiner*—Frankie L. Stinson
*Attorney, Agent, or Firm*—Pillsbury Madison & Sutro LLP

[57] ABSTRACT

A washing machine having a spraying nozzle assembly which not only evenly sprays a circulated washing liquid onto articles to be washed, but also effectively dissolves a detergent, thereby improving the washing efficiency. The spraying nozzle assembly has a hollow annular frame for receiving the washing liquid circulated by a circulation pump, a plurality of spraying ports for spraying the circulated washing liquid onto the article, and a plurality of impeller units dispersing the washing liquid sprayed by the spraying nozzles. The spraying ports extend downward by a predetermined length. The impeller unit has a bent suspension bar having a horizontal portion and a vertical portion, and an impeller rotatably coupled to the vertical portion of the bent suspension bar. A conical tip for rotatably supporting the impeller is integrally formed at an end of the vertical portion. The washing machine uniformly washes the articles. Impurities such as foam or suds remaining at a space formed between a spin tub and an outer tub are flushed by the washing liquid, so the washing effect is improved. The detergent remaining in the washing liquid in its solid state is dissolved by the friction between the washing liquid and the impeller unit, so the washing effect is further improved.

13 Claims, 4 Drawing Sheets

WASHING MACHINE HAVING A SPRAYING NOZZLE ASSEMBLY

BACKGROUND OF THE INVENTION

1. Field of the Invention

The present invention relates to a washing machine, and more particularly to a washing machine having a spraying nozzle assembly which not only can evenly spray a circulated washing liquid onto articles to be washed, but also can effectively dissolve a detergent, thereby improving the washing efficiency.

2. Prior Arts

Generally, a washing machine is an appliance for separating dirt from articles to be washed such as clothing by sequentially carrying out various cycles in the order of liquid feeding, washing, rinsing, dehydrating, and draining cycles.

While the above cycles are being executed, dirt contained in the clothing separates from the clothing by means of detergents or by means of friction between the washing liquid and the clothing.

However, in conventional washing machines, detergent particles cannot completely dissolve in the washing liquid while the washing cycle is being executed, so some of the detergent particles remain in a space formed between a spin tub and an outer tub in its solid state. For this reason, the dirt does not easily separate from the clothing and a large quantity of detergents are required for cleaning the clothing.

Further, conventional washing machines repeat the liquid feeding and draining cycles several times in order to carry out the washing and rinsing cycles, so they unnecessarily waste the washing liquid.

In order to overcome the above problems, various types of conventional washing machines which reduce a required amount of the detergent by completely dissolving the detergent in the washing liquid and prevent the washing liquid from wasting by re-using the washing liquid by circulating the washing liquid through a circulation pump, have been proposed.

U.S. Pat. No. 5,285,664 issued to Chang et al. discloses such a conventional washing machine.

FIG. 5 shows Chang's washing machine 500.

As shown in FIG. 5, Chang's washing machine 500 comprises a housing 12 having a control panel 11 at its upper portion, and an outer tub 15 disposed in housing 12 so as to receive the washing liquid. A spin tub 512 is accommodated in outer tub 15 and is formed at its side wall with a plurality of through holes 511. Washing machine 500 also has a motor 17 which generates a driving force for operating washing machine •, and a power transmission 540 for transmitting the driving force from motor 17 to spin tub 512. A circulation pump 525 is disposed at a bottom of housing 12 in such a manner that it can communicate with outer tub 15. Circulation pump 525 circulates the washing liquid through a circulation tube 521 into an adapter 520, or drains the washing liquid out of washing machine 500 through a drain tube 533.

Power transmission 540 includes a rotating shaft 542 connected to motor 17 through a belt 18 so as to receive the driving force from motor 17, a gear and link assembly 544 for rotating an agitator 548 mounted on a bottom wall of spin tub 512 in the forward and reverse directions in accordance with predetermined cycles, and a connection member 546 for connecting agitator 548 to gear and link assembly 544.

A removable lid 515 having a sprinkling guide surface 516 is mounted on an upper portion of outer tub 15, and is provided at its underside with an annular guide member 514 having a discharge silt 513. In addition, a sprinkling nozzle 518 is formed between annular guide member 514 and removable lid 515 so as to spray the washing liquid into spin tub 512.

On the other hand, circulation pump 525 has a rotating shaft 528 which is integrally formed at its one end with a pulley 529. Pulley 529 of circulation pump 525 is connected to motor 17 by means of a belt 18 in such a manner that circulation pump 525 can receive the rotational force from motor 17.

The conventional washing machine having a construction as described above operates as follows.

Firstly, when a user pushes an operating button installed on control panel 11, the washing liquid is introduced from a liquid source into a space 517 formed between removable lid 515 and guide member 514 by way of a washing liquid feed pipe 519 and adapter 520.

Then, the washing liquid that has been introduced into space 517 is sprinkled into spin tub 512 through discharge silt 513 of guide member 514 and through sprinkle nozzle 518 until a predetermined liquid level in spin tub 512 is achieved.

When the predetermined liquid level is achieved, a liquid feed control valve 530 blocks liquid feed pipe 519 and, at the same time, motor 17 rotates in the forward direction. The rotational force of motor 17 is transmitted to agitator 548 by way of belt 18, by way of rotating shaft 542 of power transmission 540, by way of gear and link assembly 544 and by way of connection member 546, so that agitator 548 rotates in the forward and reverse directions, thereby washing the clothing.

At the same time, the forward directional drive force of drive motor 17 is also transmitted to circulation pump 525 through belt 18, so that circulation pump 525 rotates in the forward direction while the washing cycle is being executed. Therefore, the washing liquid that has been introduced into outer tub 15 is discharged from outer tub 15 into circulation pump 525 through a discharge port 526 formed at the bottom wall of outer tub 15.

Upon receiving the washing liquid, circulation pump 525 compresses the washing liquid and draws the washing liquid up to adapter 520 through circulation tube 521. Then, the compressed washing liquid is introduced into space 517 and sprinkled to the clothing placed in spin tub 512 through discharge slit 513 and sprinkling nozzle 518.

When the washing cycle has finished, the washing liquid in outer tub 15 is drained out of washing machine 500 through draining tube 533. At this time, motor 17 rotates in the reverse direction so as to rotate spin tub 512. As spin tub 512 rotates, the clothing placed in spin tub 512 is subjected to centrifugal force so that the clothing is forced radially outward (i.e., toward the side wall of spin tub 512), and thereby, the washing liquid contained in the clothing is drained out through the plurality of through holes 452 formed in the side wall of spin tub 512.

On the other hand, when motor 17 rotates in the reverse direction, circulation pump 525 connected to motor 17 also rotates in the reverse direction, so the washing liquid discharged from the plurality of through holes 452 is drained out of washing machine 500 through circulation pump 525.

However, the conventional washing machine constructed as described above has the following disadvantages.

Firstly, the washing machine sprays the washing liquid through the sprinkling nozzle which has a relatively small size, so it takes a long time to spray a predetermined amount of the washing liquid into the spin tub.

Further, since the sprinkling nozzle is only formed at one spot of the outer tub, the washing machine does not evenly spray the washing liquid onto the clothing when the clothing is fully loaded in the spin tub.

SUMMARY OF THE INVENTION

The present invention has been made to overcome the above described problems of the prior art and accordingly, it is an object of the present invention to provide a washing machine which not only can evenly spray a circulated washing liquid onto the articles to be washed, but also can effectively dissolve a detergent, thereby improving the washing efficiency.

To achieve the above object, the present invention provides a washing machine comprising:

a housing;

an outer tub disposed in the housing so as to receive a washing liquid;

a spin tub rotatably installed in the outer tub;

an outer tub cover mounted on the outer tub;

a circulation pump disposed at a lower portion of the housing and communicated with the outer tub, the circulation pump circulating the washing liquid into the upper portion of the outer tub or draining the washing liquid out of the washing machine; and a spraying nozzle assembly for spraying and dispersing a circulated washing liquid onto an article to be washed which is placed in the spin tub, the spraying nozzle assembly being mounted on the outer tub cover, wherein the spraying nozzle assembly includes a hollow annular frame securely fixed to the outer tub cover for receiving the washing liquid circulated by the circulation pump, a first means for spraying the circulated washing liquid onto the article, and a second means for dispersing the washing liquid sprayed by the first means.

According to a preferred embodiment of the present invention, the first means includes a plurality of spraying ports which are integrally formed at an underside of the hollow annular frame. The plurality of spraying ports extend downward by a predetermined length.

The second means includes four impeller units installed in four spraying ports at intervals of 90 degrees. Each impeller unit includes a bent suspension bar having a horizontal portion and a vertical portion, and an impeller rotatably coupled to the vertical portion of the bent suspension bar. The impeller includes a boss having a central hole, and four helical fans which are regularly provided around an outer wall of the boss.

A substantially conical tip for rotatably supporting the impeller is integrally formed at an end of the vertical portion. The conical tip is made by a flexible material and is formed at a center thereof with a slot having a predetermined depth.

The washing machine having the construction as described above operates as follows.

Firstly, when a user pushes an operating button installed on a control panel, the washing liquid is introduced from a liquid source into the outer tub until a liquid level in the outer tub reaches a predetermined level.

Then, if the liquid level in the outer tub reaches the predetermined liquid level, the washing liquid stops being supplied into the outer tub. At the same time, the motor rotates in the forward and reverse directions, so the pulsator rotates in the forward and reverse directions, thereby washing the articles.

At the same time, the circulation pump operates in accordance with a predetermined algorithm so that some of the washing liquid is discharged from the outer tub into the circulation pump.

Upon receiving the washing liquid, the circulation pump compresses the washing liquid and circulates the washing liquid into the spraying nozzle assembly.

Then, the washing liquid sprays into the spin tub through spraying ports formed at the underside of the hollow annular frame.

At this time, the washing liquid sprayed into the spin tub is dispersed by the impeller units installed in the spraying ports. That is, the washing liquid passing through the spraying ports is subjected to a centrifugal force by the rotation of the impeller, so the washing liquid is more widely sprayed into the spin tub.

Accordingly, the washing liquid not only can be evenly sprayed onto the clothing placed in the spin tub, but also can be sprayed into the upper portion of the spin tub so that impurities such as foam or suds remaining at a space formed between the spin tub and the outer tub can be flushed by the washing liquid, and thereby improving the washing effect.

In addition, while the washing liquid is being passed through the impeller, the detergent remaining in the washing liquid in its solid state can be dissolved by the friction between the washing liquid and the impeller, so the washing effect is further improved.

BRIEF DESCRIPTION OF THE DRAWINGS

The above object and other advantages of the present invention will become more apparent by describing in detail a preferred embodiment with reference to the attached drawings, in which.

DESCRIPTION OF THE PREFERRED EMBODIMENTS

Hereinafter, a preferred embodiment of the present invention will be described in detail with reference to the accompanying drawings.

Figure 1:
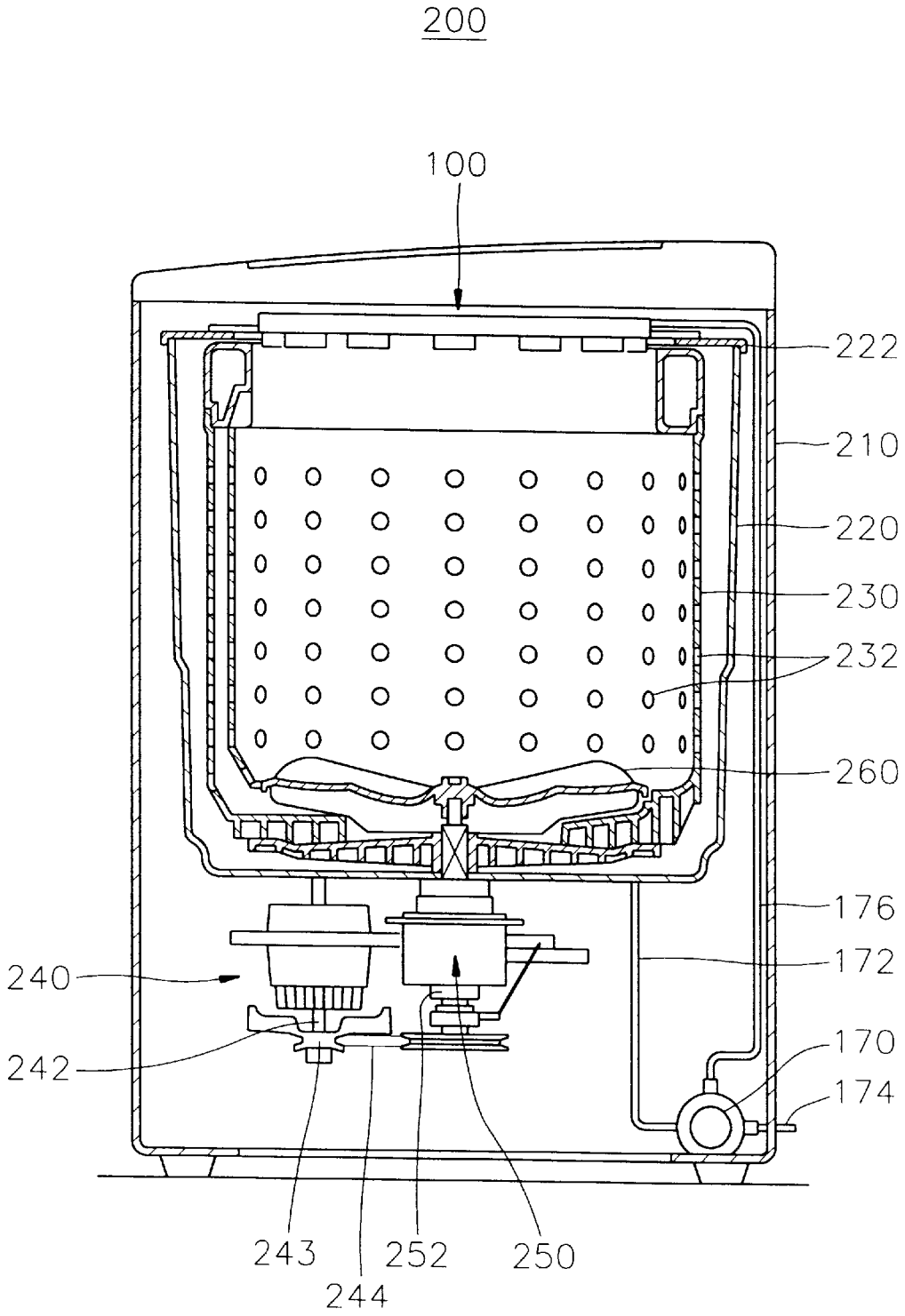
FIG. 1 is a sectional view showing the structure of a washing machine according to one embodiment of the present invention.

FIG. 1 shows a washing machine 200 according to one embodiment of the present invention.

As shown in FIG. 1, washing machine 200 has a housing 210. An outer tub 220 is disposed in housing 210 so as to receive a washing liquid, and a spin tub 230 is accommodated in outer tub 220. Spin tub 230 is formed at its side wall with a plurality of discharging holes 232. Disposed below outer tub 220 are a motor 240 generating a rotational force for operating washing machine 200, and a gear assembly 250 which receives the rotational force from motor 240 and then transmits the rotational force to spin tub 230 or to a pulsator 260 mounted on a bottom wall of spin tub 230. According to a preferred embodiment of the present invention, motor 240 includes a reversible motor.

An outer tub cover 222 is mounted on an upper portion of outer tub 220 and a spraying nozzle assembly 100 is mounted on an upper surface of outer tub cover 222 so as to spray the washing liquid onto the clothing. Spraying nozzle assembly 100 is fixedly coupled to outer tub cover 222 by a well-known fastening means such as a bolt or a fusion welding. In order to easily put the clothing into spin tub 230, outer tub cover 222 is detachably coupled to outer tub 220.

A circulation pump 170 is disposed at a lower portion of housing 210. Circulation pump 170 is communicated with outer tub 220 so as to circulate the washing liquid into spraying nozzle assembly 100 or so as to drain the washing liquid out of washing machine 200 through a drain tube 174.

Motor 240 has a motor shaft 242 which is formed at its lower end with a first pulley 243. Gear assembly 250 has a rotating shaft 252 which is formed at its lower end with a second pulley 254. Second pulley 254 is connected to first pulley 243 by a belt 244 in such a manner that the rotational force of motor 240 can be transmitted to gear assembly 250.

In addition, circulation pump 170 has a pump motor (not shown) therein and is connected to outer tub 220 through a discharging tube 172 so as to receive the washing liquid from outer tub 220. Circulation pump 170 is also connected to spraying nozzle assembly 100 through a circulation tube 176 so that the circulated washing liquid is sprayed into spin tub 230.

Figure 2:
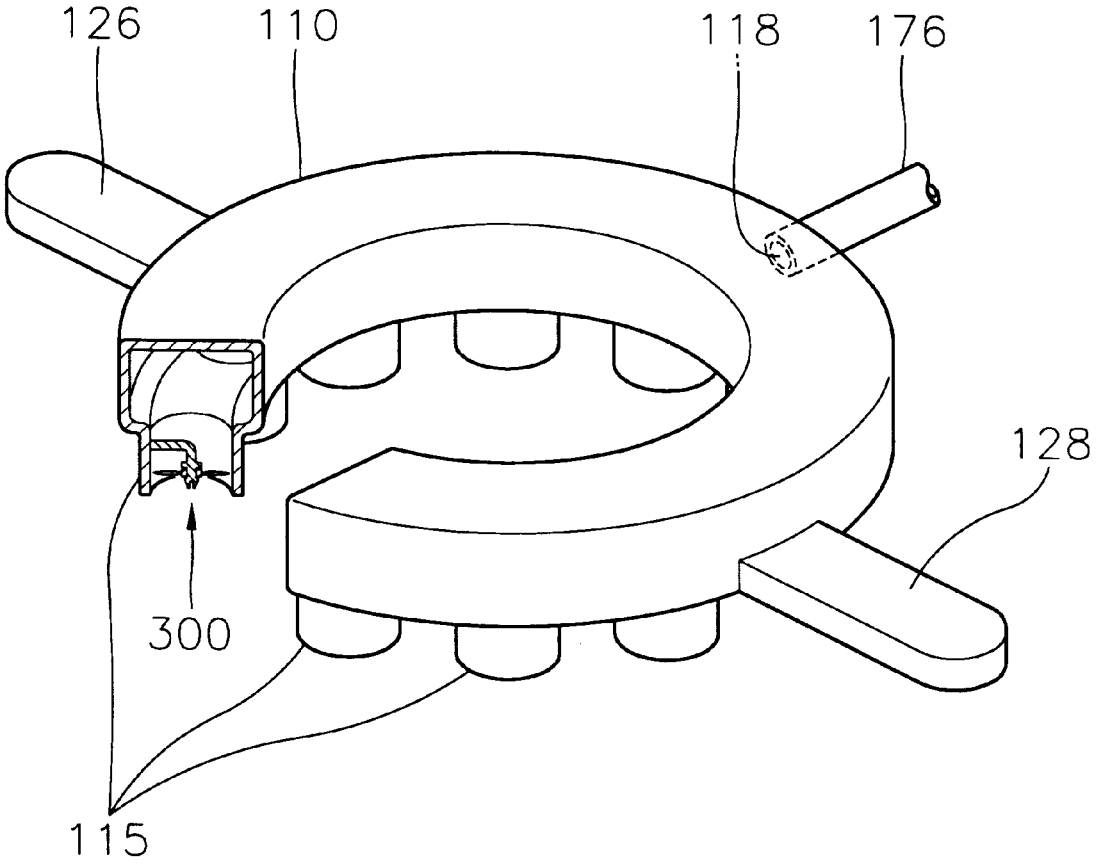
FIG. 2 is a partially sectioned perspective view of a spraying nozzle assembly shown in FIG. 1.

Referring to FIG. 2, spraying nozzle assembly 100 has a hollow annular frame 110 for receiving the circulated washing liquid which is circulated by circulation pump 170. Hollow annular frame 110 is integrally formed with a pair of knobs 126 and 128 which are disposed on a circumference of hollow annular frame 110 in opposition to each other and extend in a transverse direction. An aperture 118, into which circulation tube 176 is inserted, is formed at a predetermined position on the circumference of hollow annular frame 110. The pair of knobs 126 and 128 are fixedly coupled to outer tub cover 222, so spraying nozzle assembly 100 is stably maintained at the upper portion of outer tub 220 while washing machine 200 is being executed.

Hollow annular frame 110 is provided at its underside with a plurality of spraying ports 115 which extend downward by a predetermined length. In order to evenly spray the circulated washing liquid onto the clothing, spraying ports 115 are regularly spaced at a predetermined distance apart from each other.

A plurality of impeller units 300 for dispersing the sprayed washing liquid are fixedly installed in spraying ports 115. However, it is not necessarily required that each impeller unit 300 is installed in each spraying port 115. For example, impeller unit 300 can be installed in four spraying ports 115 at intervals of 90 degrees respectively, or impeller unit 300 can be installed in six spraying ports 115 at intervals of 60 degrees respectively.

Figure 3:
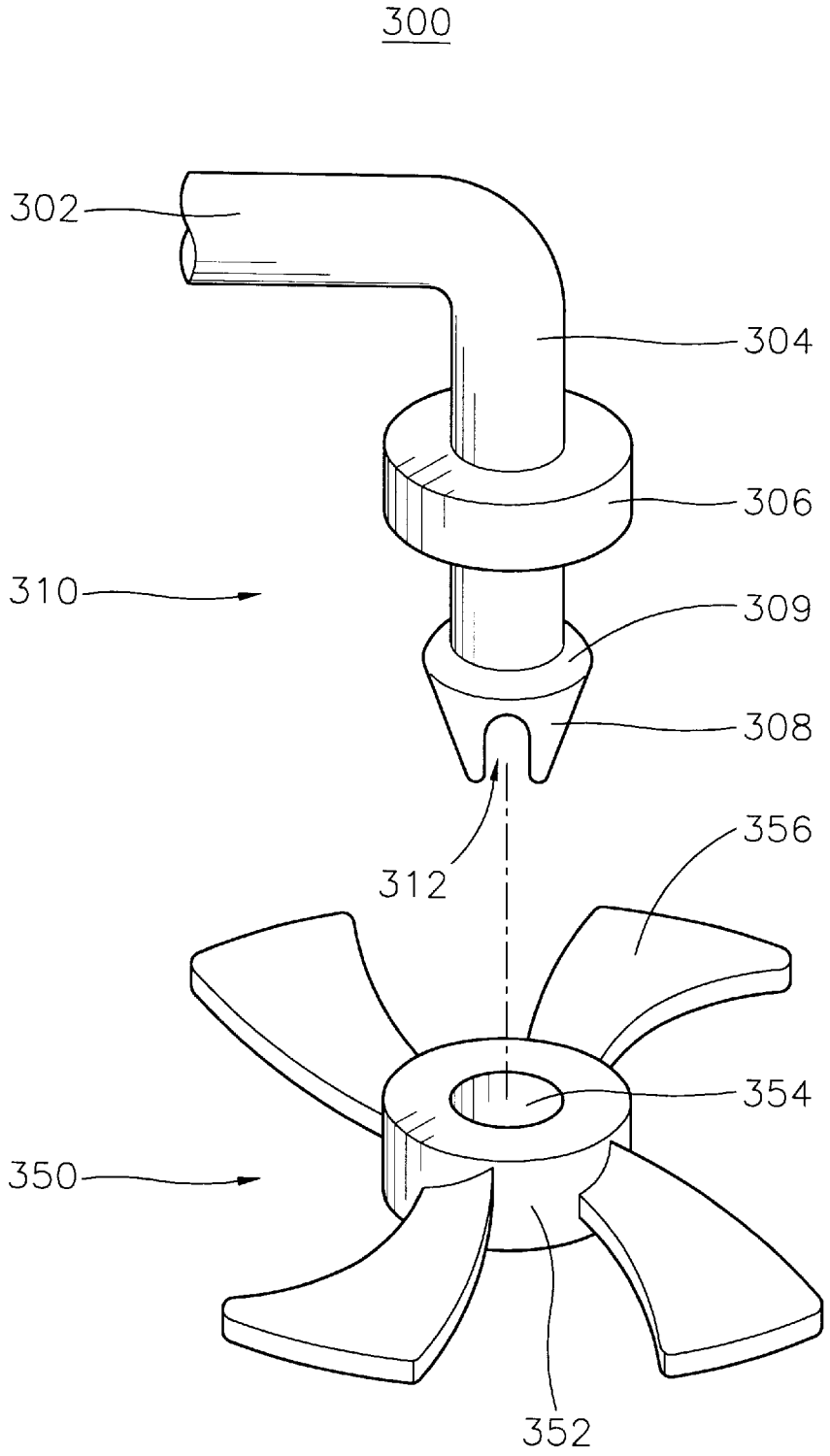
FIG. 3 is an exploded perspective view of an impeller unit which is installed in the spraying nozzle assembly.
Figure 4:
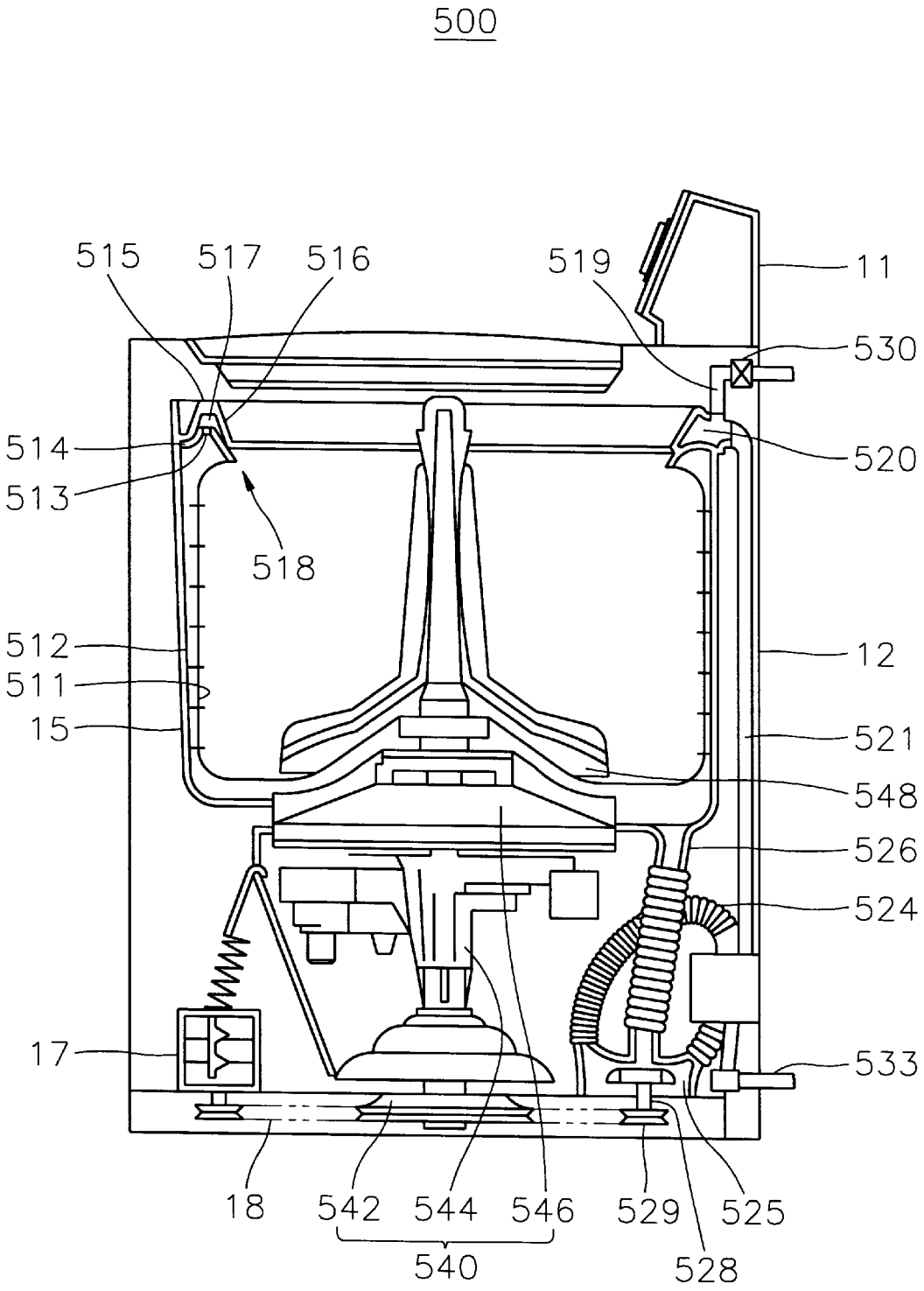
FIG. 4 (PRIOR ART)
FIG. 4 is a sectional view showing the structure of a conventional washing machine.

Referring to FIG. 3, impeller unit 300 includes a bent suspension bar 310 having a horizontal portion 302 and a vertical portion 304, and includes an impeller 350 which is rotatably coupled to vertical portion 304 of bent suspension bar 310.

Impeller 350 includes a boss 352 having a central hole 354, and a plurality of helical fans 356 which are regularly provided around an outer wall of boss 352. Preferably, four helical fans 356 are provided around the outer wall of boss 352.

An end of horizontal portion 302 is securely fixed to an inner wall of spraying port 115. A tip 308 having a substantially conical shape is integrally formed at an end of vertical portion 304. Conical tip 308 is made of a flexible material. Accordingly, when conical tip 308 is inserted into central hole 354 of boss 352 so as to be put together with impeller 350, conical tip 308 is compressed radially inward so that conical tip 308 can pass through central hole 354 of boss 352 and that a seat portion 309 of conical tip 308 can make contact with the underside of boss 352. At this time, since a slot 312 having a predetermined depth is formed at a center of conical tip 308, conical tip 308 is more easily compressed. Seat portion 309 of conical tip 308 has an outer diameter larger than an outer diameter of central hole 354 of boss 352, so impeller 350 can be rotatably supported on seat portion 309 of conical tip 308.

In addition, an annular flange 306 for preventing the up-down movement of impeller 350 is integrally formed at a predetermined position on vertical portion 304. Impeller 350 is disposed between annular flange 306 and conical tip 308. Preferably, an touter diameter of annular flange 306 is identical to an outer diameter of boss 352.

Washing machine 200 having the construction as described above operates as follows.

Firstly, when a user pushes an operating button installed on a control panel, the washing liquid is introduced from a liquid source into outer tub 220 until a liquid level in outer tub 220 reaches a predetermined level.

Then, when the liquid level in outer tub 220 reaches the predetermined liquid level, a liquid feed control valve blocks a liquid feeding pipe, so the washing liquid stops being supplied into outer tub 220. At the same time, motor 240 rotates in the forward and reverse directions. The rotational force of motor 240 is transmitted to pulsator 260 by way of motor shaft 242, first pulley 243, belt 244, second pulley 254, and gear assembly 250. As a result, pulsator 260 rotates in the forward and reverse directions, thereby washing the articles.

At the same time, an operating signal is transmitted to the pump motor accommodated in circulation pump 170 in accordance with a predetermined algorithm so that the pump motor rotates in the forward direction. When the pump motor rotates in the forward direction, a first valve disposed between circulation pump 170 and circulation tube 176 is opened and a second valve disposed between circulation pump 170 and drain tube 174 is closed. In addition, as the pump operates, circulation pump 170 also operates, so that some of the washing liquid that has been introduced into outer tub 220 is discharged from outer tub 220 into circulation pump 170 through discharging tube 172.

Upon receiving the washing liquid, circulation pump 170 compresses the washing liquid and circulates the washing liquid through circulation tube 176 into spraying nozzle assembly 100 mounted on the upper surface of outer tub cover 222.

That is, the compressed washing liquid flows into hollow annular frame 110 through aperture 118.

Then, the washing liquid sprays into spin tub 230 through spraying ports 115 formed at the underside of hollow annular frame 110. At this time, the washing liquid sprayed into spin tub 230 is dispersed by impeller units 300 installed in spraying ports 115. That is, the washing liquid passing through spraying ports 115 collides with helical fans 356 of impeller unit 300, thereby rotating helical fans 356. Accordingly, the washing liquid passing through helical fans 356 is subjected to a centrifugal force by the rotation of helical fans 356, so the washing liquid is more widely sprayed into spin tub 230.

Accordingly, the washing liquid not only can be evenly sprayed onto the clothing placed in spin tub 230, but also can be sprayed into the upper portion of spin tub 230 so that impurities such as foam or suds remaining at a space formed between spin tub 230 and outer tub 220 can be flushed by the washing liquid, thereby improving the washing effect.

In addition, while the washing liquid is being passed through impeller 350, the detergent remaining in the washing liquid in its solid state can be dissolved by the friction between the washing liquid and helical fans 356, so the washing effect is further improved.

When the washing cycle has finished, the pump motor rotates in the reverse direction. At this time, the first valve disposed between circulation pump 170 and circulation tube 176 is closed, and the second valve disposed between circulation pump 170 and drain tube 174 is opened. Accordingly, the washing liquid filled in outer tub 220 is drained out of washing machine 200 by way of discharging tube 172, circulation pump 170, and draining tube 174.

As described above, the washing machine of the present invention can evenly and widely spray the circulated washing liquid through the spraying nozzle assembly onto the articles placed in the spin tub, so the clothing can be uniformly washed.

Further, since the washing liquid can be sprayed into the upper portion of the spin tub, impurities such as foam or suds remaining at a space formed between the spin tub and the outer tub can be flushed by the washing liquid, thereby improving the washing effect.

In addition, while the washing liquid is being passed through the impeller, the detergent remaining in the washing liquid in its solid state can be dissolved by the friction between the washing liquid and the helical fans, so the washing effect is further improved.

While the present invention has been particularly shown and described with reference to a preferred embodiment thereof, it will be understood by those skilled in the art that various changes in form and detail may be effected therein without departing from the spirit and scope of the invention as defined by the appended claims.

What is claimed is:

1. A washing machine comprising:

a housing;

an outer tub disposed in the housing so as to receive a washing liquid;

a spin tub rotatably installed in the outer tub;

an outer tub cover mounted on the outer tub;

a circulation pump disposed at a lower portion of the housing and communicated with the outer tub, the circulation pump circulating the washing liquid into the upper portion of the outer tub or draining the washing liquid out of the washing machine; and a spraying nozzle assembly for spraying and dispersing a circulated washing liquid onto an article to be washed which is placed in the spin tub, the spraying nozzle assembly being mounted on the outer tub cover, wherein the spraying the nozzle assembly includes a hollow annular frame securely fixed to the outer tub cover for receiving the washing liquid circulated by the circulation pump, a plurality of spraying ports which are integrally formed at an underside of the hollow annular frame for spraying the circulated washing liquid onto the article, and a plurality of impeller units for dispersing the washing liquid sprayed by the spraying port, each impeller unit being installed in each spraying port.

2. The washing machine as claimed in claim 1, wherein the spraying nozzle assembly is fixedly coupled to the outer tub cover by means of a fusion welding.

3. The washing machine as claimed in claim 1, the hollow annular frame is formed integrally with a pair of knobs which are disposed on a circumference of the upper frame in opposition to each other and extend in a transverse direction, the pair of knobs being fixedly coupled to the outer tub cover.

4. The washing machine as claimed in claim 1, wherein the plurality of spraying ports extend downward by a predetermined length.

5. The washing machine as claimed in claim 4, wherein the spraying ports are regularly spaced at a predetermined distance apart from each other.

6. The washing machine as claimed in claim 5, wherein the four impeller units and four spraying ports are provided at intervals of 90 degrees respectively, each impeller unit including a bent suspension bar having a horizontal portion and a vertical portion, and an impeller rotatably coupled to the vertical portion of the bent suspension bar.

7. The washing machine as claimed in claim 6, wherein an end of the horizontal portion is securely fixed to an inner wall of the spraying port.

8. The washing machine as claimed in claim 6, wherein the impeller includes a boss having a central hole, and four helical fans which are regularly provided around an outer wall of the boss.

9. The washing machine as claimed in claim 8, wherein a substantially conical tip for rotatably supporting the impeller is integrally formed at an end of the vertical portion, the conical tip making contact with an underside of the boss by passing through the central hole of the boss, the conical tip having an outer diameter larger than an outer diameter of the central hole of the boss.

10. The washing machine as claimed in claim 9, wherein a slot having a predetermined depth is formed at a center of the conical tip.

11. The washing machine as claimed in claim 9, wherein the conical tip is made of a flexible material.

12. The washing machine as claimed in claim 9, wherein an annular flange for preventing an up-down movement of the impeller is integrally formed at a predetermined position on the vertical portion, the impeller being disposed between the annular flange and the conical tip.

13. The washing machine as claimed in claim 12, wherein the annular flange has an outer diameter which is identical to an outer diameter of the boss.

* * * * *